United States Patent [19]

Lee

[11] 4,372,374

[45] Feb. 8, 1983

[54] VENTED HEAT TRANSFER TUBE ASSEMBLY

[75] Inventor: Marlow Lee, Clawson, Mich.

[73] Assignee: Ateliers des Charmilles S.A., Geneva, Switzerland

[21] Appl. No.: 166,957

[22] Filed: Jul. 8, 1980

Related U.S. Application Data

[63] Continuation-in-part of Ser. No. 112,393, Jan. 15, 1980.

[51] Int. Cl.[3] ..... F28F 11/00

[52] U.S. Cl. ..... 165/70; 165/154

[58] Field of Search ..... 165/180, 138, 154, 70, 165/177

[56] References Cited

U.S. PATENT DOCUMENTS

| | | | |
|---|---|---|---|
| 2,914,091 | 11/1959 | Barnes et al. | 138/115 |
| 3,386,497 | 6/1968 | Feldmeier | 165/11 |
| 3,460,612 | 8/1969 | Valyi | 165/180 |
| 3,831,675 | 8/1974 | McLain | 165/177 |
| 3,991,822 | 11/1976 | Morris | 138/115 |

FOREIGN PATENT DOCUMENTS

| | | | |
|---|---|---|---|
| 99174 | 8/1961 | Netherlands | 165/177 |
| 1145513 | 3/1969 | United Kingdom | 165/70 |

*Primary Examiner*—Samuel Scott
*Assistant Examiner*—Margaret A. Focarino
*Attorney, Agent, or Firm*—Hauke and Patalidis

[57] ABSTRACT

A vented heat transfer tube assembly comprising a pair of fluid circulation tubes disposed co-axially one within the other, the inner tube being double-walled and held substantially concentric within the outer tube by a plurality of pairs of diametrally opposed depressions or dimples formed in the peripheral surface of the outer tube at regular intervals. Each depression or dimple projects inwardly such as to engage and indent the peripheral surface of the inner tube and to cause a corresponding portion of the inner tube to bulge inwardly during forming of the dimples in the periphery of the outer tube. The double-walled inner tube is thus coaxially supported within and assembled to the outer tube by the dimples, and a fluid may be circulated through the inner tube while another fluid is circulated in the annular space between the peripheral surface of the inner tube and the inner surface of the outer tube with the result that, when the fluids are at different temperatures, heat may be transferred from one fluid to the other through the double wall of the inner tube. The double-walled inner tube is made of coaxially disposed tubes or conduits, at least one of which is provided with longitudinal bulges forming fluted passageways or channels vented to the ambient, such that accidental leakage of fluid circulating in the inner tube, or of fluid circulating between the inner tube and the outer tube, is vented to the ambient, rather than causing intermixing of fluids. The venting passageways or channels may be filled with a chemically inert good heat conductive material, preferably in the form of a gel, and the two coaxially disposed tubes are in tight surface contact with each other between the fluted passageways or channels.

18 Claims, 9 Drawing Figures

FIG. 1
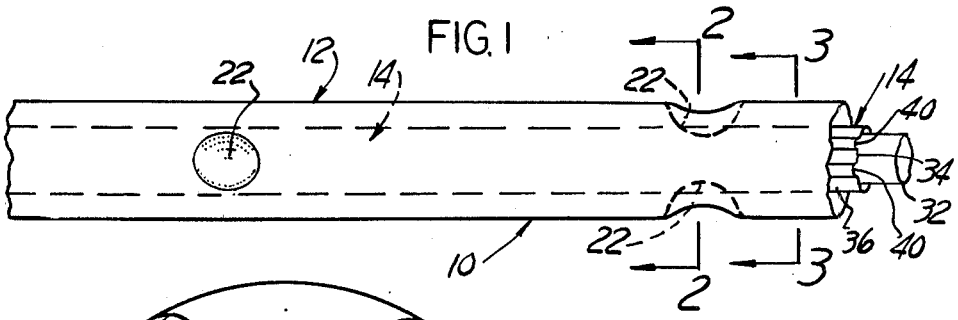
FIG. 2
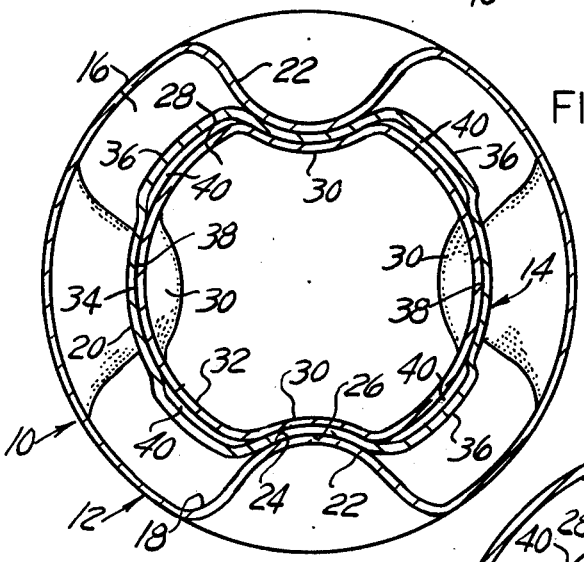
FIG. 3
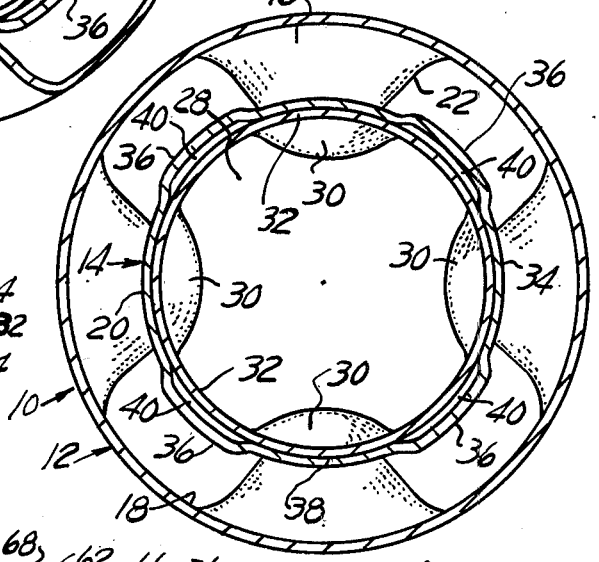
FIG. 8
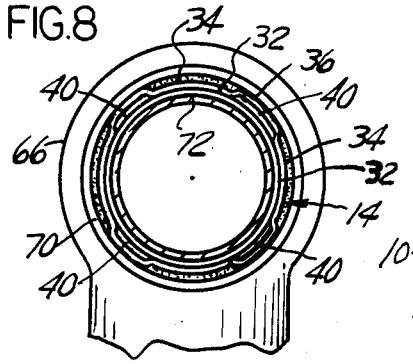
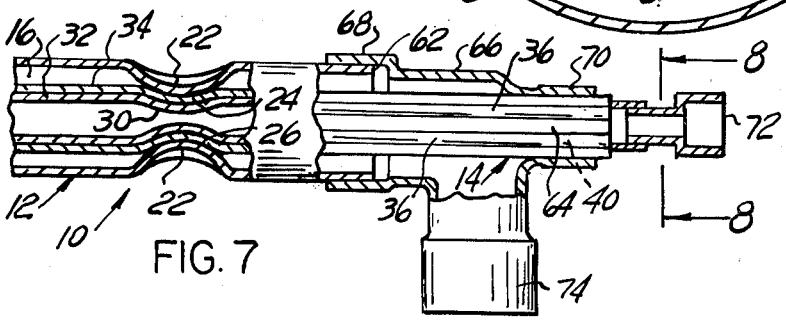
FIG. 7

VENTED HEAT TRANSFER TUBE ASSEMBLY

CROSS-REFERENCE TO RELATED APPLICATION

The present application is a continuation-in-part of application Ser. No. 112,393, filed Jan. 15, 1980 for Heat Transfer Tube Assembly, and assigned to the same assignee as the present application.

BACKGROUND OF THE INVENTION

The present invention is concerned with a structure for heat transfer tubes for heat exchangers and the like, and more particularly the present invention relates to a structure for heat transfer tubes for providing venting to the ambient of fluid leaking from a fluid flow enclosure to the other.

Heat exchangers are commonly used for the purpose of transferring heat from a fluid, such as a liquid flowing in an enclosure, to another fluid flowing in an adjacent enclosure without intermixing the fluids. Heat exchangers are in common use in some applications of solar heating devices utilizing a fluid, such as a liquid fluid of high heat absorbing capacity, circulating through a primary fluid flow circuit connected to the solar heat absorber, and where it is desired to transfer the heat from the heated fluid in the primary circuit to another fluid, such as ordinary water or air, circulating in a secondary fluid flow circuit. Heat exchangers are also commonly used in marine and in stationary industrial internal combustion engine installations for absorbing heat from the engine closed cooling system, and in nuclear reactors for cooling the reactor and for utilizing the heat generated by the reactor.

Heat exchangers are often complex devices with many welded or brazed fittings and connections, and they are subject to rapid deterioration, especially when one of the fluids has a corrosive action on the wall of the containing vessels, conduits, and junctions. Conventional heat exchangers are bulky, expensive to fabricate, subject to corrosion and prone to develop leaks.

The invention disclosed in the aforementioned application for Letters Patent remedies the inconveniences of conventional heat exchangers by providing a novel structure for heat transfer tubes for use in heat exchangers, which can be mass-produced in convenient sizes and lengths, and which can be cut from stock to any appropriate lengths for fabricating heat exchanger units of any desired capacity by interconnecting by means of conventional fittings. Heat transfer tubes according to the invention disclosed in said application may be mass-produced at low cost on continuous lines or in batches by means of simple tooling, and consist essentially of an assembly of two conventional tubular elements mounted one within the other and held in spaced apart relationship concentrically to each other by simple wall deformation of the elements, thus requiring no separate holding and connecting members, and no welding, soldering or brazing.

SUMMARY OF THE INVENTION

The present invention is an improvement over the invention disclosed in said application, providing a double-walled inner tube formed of a pair of concentrically disposed conduits, the outermost of which is shrunk over the innermost one, one of the conduits or both conduits being peripherally shaped such as to form longitudinally disposed vent or drainage passageways or channels running the whole length of the double-walled inner tube and vented to the ambient, with the result that any fluid which may tend to leak from a fluid flow circuit to the other is trapped in the vent or drainage passageway or channel and exhausted to the ambient, thus preventing intermixing of the two fluids and providing a visual indication, upon inspection, that the inner tube has developed an accidental or useage-induced leak which could not be detected by other means.

The diverse objects and advantages of the present invention will become apparent to those skilled in the art when the following description of the best mode contemplated for practicing the invention is read in conjunction with the accompanying drawing wherein:

BRIEF DESCRIPTION OF THE DRAWING

FIG. 1 is an elevation view of a length of vented heat transfer tube according to the present invention;

FIG. 2 is a transverse section along line 2—2 of FIG. 1;

FIG. 3 is a transverse section along line 3—3 of FIG. 1;

FIG. 7 is a partial elevational and sectional view through the end of a vented heat transfer tube according to the present invention cut off for mounting on the end thereof appropriate fittings for connection to external circuits;

FIG. 8 is a transverse section along line 8—8 of FIG. 7; and

DETAILED DESCRIPTION OF THE PREFERRED EMBODIMENTS

Figure 4:
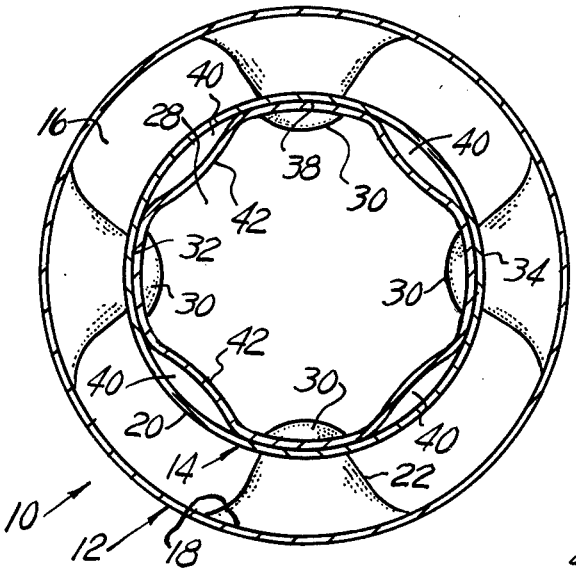
FIG. 4 is a view similar to FIG. 3, but showing a modification thereof.

Referring now to the drawing, and more particularly to FIGS. 1–3, a heat transfer tube 10 according to the present invention comprises a metallic elongated tubular conduit member or tube 12 having a second elongated tubular conduit member or tube 14 rigidly mounted concentrically within the outer tube 12, such that a generally annular space 16 is formed between the interior wall surface 18 of the outer tube 12 and the peripheral surface 20 of the inner tube 14. The inner tube 14 is held substantially concentric to the outer tube 12 as a result of the outer tube 12 being provided with a plurality of concave indentations of dimples 22 projecting inwardly and radially such as to form a domed surface 24, FIG. 2, engaged into a conforming inwardly directed depression or recess 26 formed in the peripheral surface 20 of the inner tube 14. Preferably, a pair of diametrally disposed dimples 22 are formed at regular intervals, the axis of the dimples in each pair being at a right angle to the axis of the next consecutive pair of dimples 22. In this manner, the inner tube 14 is held co-axially within the larger outer tube 12, without requiring any welding, brazing or other assembly arrangement, and an appropriate fluid, such as a liquid, may be longitudinally circulated through the annular space 16, while another fluid may be circulated through the interior 28 of the inner tube 14.

The inner tube 14 is made of welded-seam or, preferably, seamless metallic tube such as copper tubing and the like, providing good heat transfer from the interior 28 of the inner tube 14 through its wall to the annular space 16 surrounding its peripheral surface 20. The outer tube 12 is also made of metallic seamless or welded-seam tubing, preferably of the same material as the inner tube 14 to prevent electrolytic corrosion of the wetted surface, especially where the surfaces are proximate or in firm contact with each other, for example where the domed surface 24 of the dimples 22 formed in the outer tube 12 engages the surface of the recess 26 formed in the peripheral surface 20 of the inner tube 14. Disposing the dimples 22 in diametrally opposed pairs with the axis of each pair at substantially a right angle to the axis of the adjoining diametrally opposed pairs of dimples tends to divert the flow of fluid through the annular space 16 and creates turbulence which facilitate the heat exchange between the fluid circulating in the annular space 16 and the fluid circulating through the interior 28 of the inner tube 14. The recesses 26 are formed by deformation of the wall of the inner tube 14 such as to cause on the interior 28 of the tube diametrally opposed pairs of convex projections 30 which, without causing undue restriction to the flow of fluid through the interior 28 of the inner tube 14, tend to agitate and cause turbulence of the fluid circulating through the interior 28 of the inner tube 14.

The inner tube 14 is double-walled, as illustrated, i.e. made of an inner tubular conduit 32 disposed within an outer tubular conduit 34, the outer conduit 34 being shrunk by rolling or, preferably, passage through a sizing die for reducing its diameter while simultaneously reducing slightly the diameter of the inner conduit 32. In the example of structure of FIGS. 1–3 and as best shown at FIGS. 2 and 3, the outer conduit 34 is formed with longitudinally extending, radially projecting, upwardly bulging wall portions 36 regularly disposed about the periphery of the outer conduit 34, such that when the outer conduit 34 is shrunk over the inner conduit 32, the outer surface of the inner conduit 32 is intimately in contact with the inner surface of the outer conduit 34, as illustrated at 38, and other portions corresponding to each of the longitudinal bulges 36 formed in the wall of the outer conduit 34 are spaced apart such as to form longitudinal venting passageways or channels 40 extending the whole length of the double-walled inner tube 14. The size of the diverse elements and their arrangement are such that, in the structure illustrated, there are four such venting passageways or channels 40 each disposed between the portions of the inner conduit 32 and of the outer conduit 34 in intimate surface contact, as is shown at 38, and the dimples 22 are formed at locations where the inner tubular conduit 32 engages with the outer tubular conduit 34, such as not to interfere with the venting passageways or channels 40.

The venting passageways or channels 40 act as evacuation conduits for any fluid attempt leak from the interior 28 of the double-walled inner tube 14 to the annular space 16 or for fluid attempting to leak from the annular space 16 through the double wall of the inner tube 14, in the event that the wall of the inner conduit 32 or the wall of the outer conduit 34, respectively, experiences a crack or a rupture while in service. The venting passageways or channels 40 are vented to the ambient, such that any contamination of one of the fluids by the other is prevented as the leaking fluid is evacuated to the ambient. The venting passageways or channels 40 may be left empty or, in the alternative, if so desired they may be filled during manufacturing of the heat transfer tube 10 with a material preferably in the form of a gel which provides relatively good transfer of heat from the wall of the inner conduit 32 to the wall of the outer conduit 34 through the space formed by the passageways or channels 40 by convection through the material filling the space in the venting passageways or channels. Ethylene glycol aqueous solutions in the form of a gel by addition of sodium silicate or the like, and silicone resins have been found convenient as materials for filling the venting passageways or channels 40. Other materials may be used to fill the passageways or channels 40 such as crystaline materials or salts soluble in the liquid fluids used in the heat exchanger system. The leaking fluid captured in the venting passageways or channels 40 tends to dissolve or displace, as the case may be, the crystaline materials, the salts or the gel contained in the passageways or channels through the venting aperture to the ambient such that, in addition to the fluids themselves being vented to the ambient, the gel, crystaline materials or salts seeping through the venting aperture provides an indication of a leakage having occurred.

Figure 5:
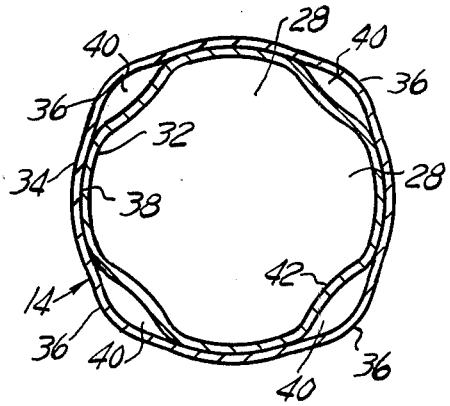
FIGS. 5 and 6 are transverse sections through further modifications of vented inner tubes for vented heat transfer tubes according to the invention.

As shown at FIG. 4, instead of providing the outer conduit 34 with longitudinally bulging wall portions, the outer conduit 34 forming part of the inner tube 14 may be formed substantially cylindrical and the inner conduit 32 provided with longitudinally extending inwardly directed bulges 42 forming longitudinally extending venting passageways or channels 40 or, in the alternative, both inner conduit 32 and outer conduit 34 may be provided with regularly disposed longitudinally extending bulges 36 and 42, respectively, such that the longitudinally extending venting passageways or channels 40 are disposed therebetween, as shown at FIG. 5.

Figure 6:
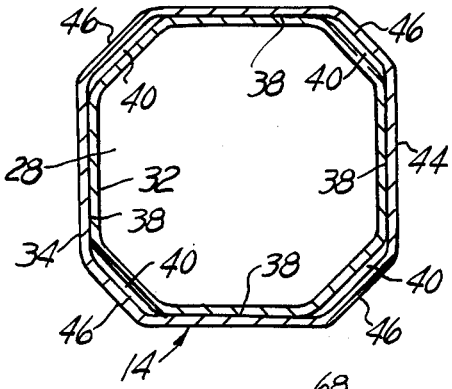

Any number of shapes of double-walled inner tubes 14 may be devised within the purview of the present invention as for example the generally octagonal, in transverse section, shape of FIG. 6 wherein the inner conduit 32 is, for example, in the shape of a regular octagon with rounded corners and the outer conduits 34 is in the form of an octagon, in section, having longer sides 44 alternating with shorter sides 46 such that between each shorter side 46 of the outer conduit 34 and the corresponding side of the inner conduit 32 the venting passageways or channels 40 are thus formed, the longer side 44 of the outer conduit 34 being in tight engagement, as shown at 38, with the corresponding side of the inner conduit 32.

The heat transfer tubes of the invention are preferably manufactured on a continuous line, or by batches, the assembly of the double-walled inner tube 14 within the outer tube 12 being effected by the roll apparatus described in detail in co-pending application Serial No. 112,393, the only difference being that manufacture of the double-walled vented heat transfer tube of the present invention requires substantial accurate alignment of the inner tube 14 relative to the dimple forming mechanism at the start of an assembly operation such that the dimples 22 will be formed at the location where the inner conduit 32 and the outer conduit 34 are in firm engagement with each other, and the venting passageways or channels 40 are disposed between rows of dimples. Alternatively, the dimples may be formed by means of a die and forming-punch apparatus.

Figure 9:
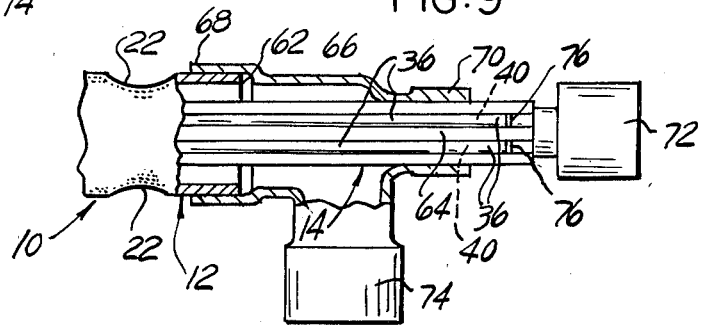
FIG. 9 is a view similar to FIG. 7, but showing a modification thereof.

In use, the heat transfer tubes 10 of the invention are cut to an appropriate length, first by effecting a cut through both the peripheral or outer tube 12 and the inner tube 14, and subsequently effecting a cut only through the wall of the outer tube 12, as shown at 62 at FIGS. 7 and 9, thus leaving on the end, a projecting end portion 64 of the inner tube 14 beyond the cut end 62 of the outer tube 12. A T-shaped connector 66, for example, has an end 68 fitted over the cut end 62 of the outer tube 12 and soldered or brazed in position. The connector 66 has another end 70 of reduced diameter fitting the outer conduit 34 of the double-walled inner tube 14 at its end projecting portion 64, soldered or brazed thereto. A connector 72 is soldered or brazed in the end of the inner tube 14 for forming a junction with an inlet, or outlet, conduit (not shown) for the fluid circulating through the inner tube 14. The other end 74 of the T-shaped connector 66 may be connected to a fluid inlet or outlet, as the case may be, or connected in the same manner to another length of heat transfer tube 10, either in series or in parallel, as desired for fabricating heat exchanger units of greater capacity than provided by a single length of heat transfer tube.

As best shown at FIG. 8, the cut end of the double-walled inner tube 14 provides open ends for the venting passageways or channels 40 directly to the ambient, such that any leakage of fluid into the venting passageways or channels 40 may be evacuated to the ambient. As a further precaution to ensure that each passageway or channel 40 is actually open to the ambient, in the event that dirt, solder or brazing alloy obturate the open ends of the passageway or channel 40 during soldering or brazing in position of the connectors and more particularly the connector 72, a slit 76, as shown at FIG. 9, is provided by effecting a saw cut through the wall of the outer conduit 34 at each longitudinal bulge 36 thereof forming a passageway or channel 40 between the bulge inner surface and the corresponding outer surface of the inner conduit 32 and the exposed end of the double-walled inner tube 14 beyond the end 70 of the T-shaped connector 66. In this manner, fluid leaking to the venting passageways or channels 40 is directly evacuated through the saw cuts or slits 76 to the ambient, or is caused to displace the gel or other material filling the passageways or channels 40 through the saw cuts 76, even though the end of the passageway or channel 40 at the cut end of the double-walled inner tubing 14 may be clogged by dirt, solder or brazing material.

Having thus described the present invention by way of structural examples thereof, modifications whereof will be apparent to those skilled in the art.

What is claimed as new is as follows:

1. A vented heat transfer tube comprising a first tubular member having an interior wall surface, a second tubular member disposed within said first tubular member and having an exterior wall surface spaced apart from the interior wall surface of said first tubular member, and a plurality of projections each extending from said interior wall surface of said first tubular member and having an end engaged in a corresponding recess formed in said exterior wall surface of said second tubular member, said projections being diametrally disposed by pairs, wherein said second tubular member comprises a pair of tubular conduit members disposed one within the other, the exteriorly disposed conduit member being shrunk onto the interiorly disposed conduit member such as to provide said second tubular member with a double wall thickness, at least one continuous bulge formed in the wall of one of said conduit members causing a portion of said wall to be disposed spaced apart from the wall of the other of said conduit members for defining a channel extending from end to end of said second tubular member, and at least one opening to the ambient provided in said channel, wherein said bulge is formed in the wall of said exteriorly disposed conduit member.

2. The vented heat transfer tube of claim 1 further comprising a slit through the wall of the outer conduit member forming said second tubular member, said slit extending into said channel.

3. The vented heat transfer tube of claim 1 further comprising a bulge formed in the wall of said interiorly disposed conduit member, said bulge extending inwardly, and said bulge formed in the wall of said exteriorly disposed conduit member extends outwardly, said two bulges being disposed in register with each other such as to form said channel therebetween.

4. The vented heat transfer tube of claim 1 wherein said projecting portions are concave dimples formed in the wall of said first tubular member, each of said dimples having a substantially dome-shaped end portion forcibly engaged in said recess in said second tubular member exterior wall surface, said channel extending along an area between rows of said recesses.

5. The heat transfer tube of claim 4 wherein one pair of said dimples are formed along a diameter of said heat transfer tube and a diameter axis of each pair of said dimples is at substantially right angle to the diameter axis of adjoining pairs, and a channel extends between each row of said recesses formed in said second tubular member by said dimples.

6. The vented heat transfer tube of claim 1 further comprising an elbow connector mounted on at least one end of said heat transfer tube, said elbow connector having an aperture through a wall thereof for affording passage to a projecting length of said second tubular member and forming a connecting passageway for said space between said first and second tubular members, and at least one slit formed in the wall of said second tubular member outermost conduit member placing said channel in communication with the ambient.

7. A vented heat transfer tube comprising a first tubular member having an interior wall surface, a second tubular member disposed within said first tubular member and having an exterior wall surface spaced apart from the interior wall surface of said first tubular member, and a plurality of projections each extending from said interior wall surface of said first tubular member and having an end engaged in a corresponding recess formed in said exterior wall surface of said second tubular member, said projections being diametrally disposed by pairs, wherein said second tubular member comprises a pair of tubular conduit members disposed one within the other, the exteriorly disposed conduit member being shrunk onto the interiorly disposed conduit member such as to provide said second tubular member with a double wall thickness, at least one continuous bulge formed in the wall of one of said conduit members causing a portion of said wall to be disposed spaced apart from the wall of the other of said conduit members for defining a channel extending from end to end of said second tubular member, and at least one opening to the ambient provided in said channel, wherein said bulge is formed in the wall of said interiorly disposed conduit member.

8. The vented heat transfer tube of claim 7 further comprising a slit through the wall of the outer conduit member forming said second tubular member, said slit extending into said channel.

9. The vented heat transfer tube of claim 7 wherein said bulge formed in the wall of said interiorly disposed conduit member extends inwardly, and another bulge is formed outwardly in the wall of said exteriorly disposed conduit member, said two bulges being disposed in register with each other such as to form said channel therebetween.

10. The vented heat transfer tube of claim 7 wherein said projecting portions are concave dimples formed in the wall of said first tubular member, each of said dimples having a substantially dome-shaped end portion forcibly engaged in said recess in said second tubular member exterior wall surface, said channel extending along an area between rows of said recesses.

11. The heat transfer tube of claim 10 wherein one pair of said dimples are formed along a diameter of said heat transfer tube and a diameter axis of each pair of said dimples is at substantially right angle to the diameter axis of adjoining pairs, and a channel extends between each row of said recesses formed in said second tubular member by said dimples.

12. The vented heat transfer tube of claim 7 further comprising an elbow connector mounted on at least one end of said heat transfer tube, said elbow connector having an aperture through a wall thereof for affording passage to a projecting length of said second tubular member and forming a connecting passageway for said space between said first and second tubular members, and at least one slit formed in the wall of said second tubular member outermost conduit member placing said channel in communication with the ambient.

13. A vented heat transfer tube comprising a first tubular member having an interior wall surface, a second tubular member disposed within said first tubular member and having an exterior wall surface spaced apart from the interior wall surface of said first tubular member, and a plurality of projections each extending from said interior wall surface of said first tubular member and having an end engaged in a corresponding recess formed in said exterior wall surface of said second tubular member, said projections being diametrally disposed by pairs, wherein said second tubular member comprises a pair of tubular conduit members disposed one within the other, the exteriorly disposed conduit member being shrunk onto the interiorly disposed conduit member such as to provide said second tubular member with a double wall thickness, at least one continuous bulge formed in the wall of one of said conduit members causing a portion of said wall to be disposed spaced apart from the wall of the other of said conduit members for defining a channel extending from end to end of said second tubular member, and at least one opening to the ambient provided in said channel, wherein said tubular conduit members are substantially octagonal in cross-section, and the interiorly disposed conduit member is disposed within the exteriorly disposed tubular conduit member with four pairs of side surfaces in engagement with each other and four pairs of side surfaces spaced away from each other for forming four channels, each pair of spaced apart side surfaces alternating with each pair of side surfaces in engagement with each other.

14. The vented heat transfer tube of claim 13 further comprising a slit through the wall of the outer conduit member forming said second tubular member, said slit extending into said channel.

15. The vented heat transfer tube of claim 13 wherein said tubular conduit members are substantially octagonal in cross-section, and the interiorly disposed conduit member is disposed within the exteriorly disposed tubular conduit member with four pairs of side surfaces in engagement with each other and four pairs of side surfaces spaced away from each other for forming four channels, each pair of spaced apart side surfaces alternating with each pair of side surfaces in engagement with each other.

16. The vented heat transfer tube of claim 13 wherein said projecting portions are concave dimples formed in the wall of said first tubular member, each of said dimples having a substantially dome-shaped end portion forcibly engaged in said recess in said second tubular member exterior wall surface, said channel extending along an area between rows of said recesses.

17. The heat transfer tube of claim 16 wherein one pair of said dimples are formed along a diameter of said heat transfer tube and a diameter axis of each pair of said dimples is at substantially right angle to the diameter axis of adjoining pairs, and a channel extends between each row of said recesses formed in said second tubular member by said dimples.

18. The vented heat transfer tube of claim 13 further comprising an elbow connector mounted on at least one end of said heat transfer tube, said elbow connector having an aperture through a wall thereof for affording passage to a projecting length of said second tubular member and forming a connecting passageway for said space between said first and second tubular members, and at least one slit formed in the wall of said second tubular member outermost conduit member placing said channel in communication with the ambient.

* * * * *

UNITED STATES PATENT AND TRADEMARK OFFICE

CERTIFICATE OF CORRECTION

PATENT NO. : 4,372,374
DATED : February 8, 1983
INVENTOR(S) : Marlow Lee

It is certified that error appears in the above-identified patent and that said Letters Patent are hereby corrected as shown below:

Abstract page:

The assignee designation should read as follows:

(73) Assignee: H & H Tube & Mfg. Co., Southfield, Michigan

Signed and Sealed this

*Twenty-fourth* Day of *January 1984*

[SEAL]

*Attest:*

GERALD J. MOSSINGHOFF

*Attesting Officer*

*Commissioner of Patents and Trademarks*